US005449210A

United States Patent [19]

Takimoto

[11] Patent Number: 5,449,210

[45] Date of Patent: Sep. 12, 1995

[54] LATCH ASSEMBLY

[75] Inventor: Kazuhide Takimoto, Tokyo, Japan

[73] Assignee: Takigen Manufacturing Co. Ltd., Tokyo, Japan

[21] Appl. No.: 191,803

[22] Filed: Feb. 3, 1994

[30] Foreign Application Priority Data

Feb. 22, 1993 [JP] Japan ..... 5-056454

[51] Int. Cl.[6] ..... E05C 17/04

[52] U.S. Cl. ..... 292/262; 292/113; 292/DIG. 49

[58] Field of Search ..... 292/247, 262, 113, DIG. 49, 292/283, 285, 200, 207, 208, 248

[56] References Cited

U.S. PATENT DOCUMENTS

| | | | |
|---|---|---|---|
| 845,781 | 3/1907 | Hawley | 292/283 |
| 3,237,978 | 3/1966 | Swanson | 292/113 |
| 3,524,667 | 8/1970 | Swanson | 292/113 |
| 3,698,753 | 10/1972 | Atkinson | 292/247 |
| 3,998,481 | 12/1976 | Anthone | 292/113 X |
| 4,679,833 | 7/1987 | Dueringer | 292/113 |

FOREIGN PATENT DOCUMENTS

| | | | |
|---|---|---|---|
| 612104 | 7/1926 | France | 292/113 |
| 2681370 | 3/1993 | France | 292/113 |
| 316855 | 10/1928 | United Kingdom | 292/283 |

*Primary Examiner*—Rodney M. Lindsey
*Attorney, Agent, or Firm*—Martin Smolowitz

[57] ABSTRACT

Latch assembly which is free from unlocking accidents even when some other articles hit against a front end of an operating lever 3 of the assembly in which: the lever 3 is pivoted to bearing plate portions 2 of a base plate 1 through a first pivot 4; a latch arm 5 is pivoted to the lever 3 through a second pivot 6; a projecting plate portions 12 of a lock plate 11 are inserted in slots 13 of guide plate portions 10 of the base plate 1; a socket-member plate 19 fixed to the lever 3 has a locking plate portions 20 in which locking notches 21 are provided; these notches 21 are engaged with the projecting plate portions 12 of the lock plate 11 and held in such engaging condition under the influence of a compression coil spring 18; and, a push plate 14 for releasing the notches 21, 21 from such engaging condition is disposed in a rear-surface side cavity portion 9 of the lever 3.

2 Claims, 3 Drawing Sheets

LATCH ASSEMBLY

BACKGROUND OF THE INVENTION

1. Field of the Invention

The present invention relates to a latch assembly applied to an instrument box and the like.

2. Description of the Prior Art

In a conventional latch assembly disclosed in Japanese Utility Model Laid-Open No. Sho 61-17635, an operating lever has its base-end portion pivoted to bearing plate portions of a base plate through a first pivot. The bearing plate portions project from an one end portion of the base plate. A latch arm has its base-end portion pivoted to an intermediate portion of the operating lever through a second pivot. The second pivot and the first pivot are so arranged that the base plate is closer to the second pivot than to a straight line drawn between the first pivot and an engaging-end portion of a socket member in a locking condition in which a front-end hook portion of the latch arm engages with the engaging-end portion of the socket member.

In the conventional assembly, since there is no means for locking the operating lever to the base plate, there is a fear that the latch arm could be accidentally disengaged from the socket member to accidentally unlock the wing element on a stationary frame element when a front-end portion of the operating lever hits against some other articles to have the operating lever swung up on the first pivot.

SUMMARY OF THE INVENTION

It is an object of the present invention to provide a latch assembly which is free from unlocking accidents even when a front-end portion of an operating lever is hit by some other articles.

The above object of the present invention is accomplished by providing:

a latch assembly comprising:

an operating lever having its base-end portion pivoted to bearing plate portions of a base plate through a first pivot, the bearing plate portions projecting from an end portion of the base plate;

a latch arm having its base-end portion pivoted to an intermediate portion of the operating lever through a second pivot;

the second pivot and the first pivot being so arranged that the base plate is closer to the second pivot than to a straight line drawn between the first pivot and an engaging-end portion of a socket member in a locking condition in which a front-end hook portion of the latch arm engages with the engaging-end portion of the socket member;

the base plate being provided with a pair of guide plate portions in its the other end portion, the guide plate portions being inserted in a rear-surface side cavity portion of the operating lever;

the guide plate portions being provided with a pair of slots extending in a longitudinal direction of the base plate, in which slots a pair of projecting plate portions of a lock plate are slidably inserted;

a push plate having its base-end portion disposed in the vicinity of a finger-engaging end portion of the operating lever, the push plate being fixedly mounted on the lock plate 11;

the push plate being provided with a spring-support plate portion in its front-end portion, the spring-support plate portion being slidably inserted in a through-hole of a spring-support plate projecting from an intermediate portion of the base plate;

a coil spring mounted on the spring-support plate portion of the push plate in an insertion manner, the coil spring being compressed between an end surface of the push plate and the spring-support plate portion to bias the push plate so that each of the projecting plate portions abuts against the far one of inner wall surfaces of each of the slots, the first pivot being far away from the far one of the inner wall surfaces than from the other one of the inner wall surfaces;

a socket-member plate fixedly mounted on the operating lever and being provided with a pair of locking plate portions projecting into a rear-surface side cavity portion, the locking plate portions being provided with a pair of locking notches in their side edge portions, the locking notches being engaged with and disengaged from the projecting plate portions of the lock plate; and each of the locking plate portions being provided with an oblique cam surface portion in its front-end portion, the oblique cam surface portion being adjacent to each of the locking notches and brought into a slidable contact with an edge surface of each of the projecting plate portions of the lock plate to slidably move the lock plate toward the other one of the inner wall surfaces along the slots.

DESCRIPTION OF THE PREFERRED EMBODIMENTS

Figure 1:
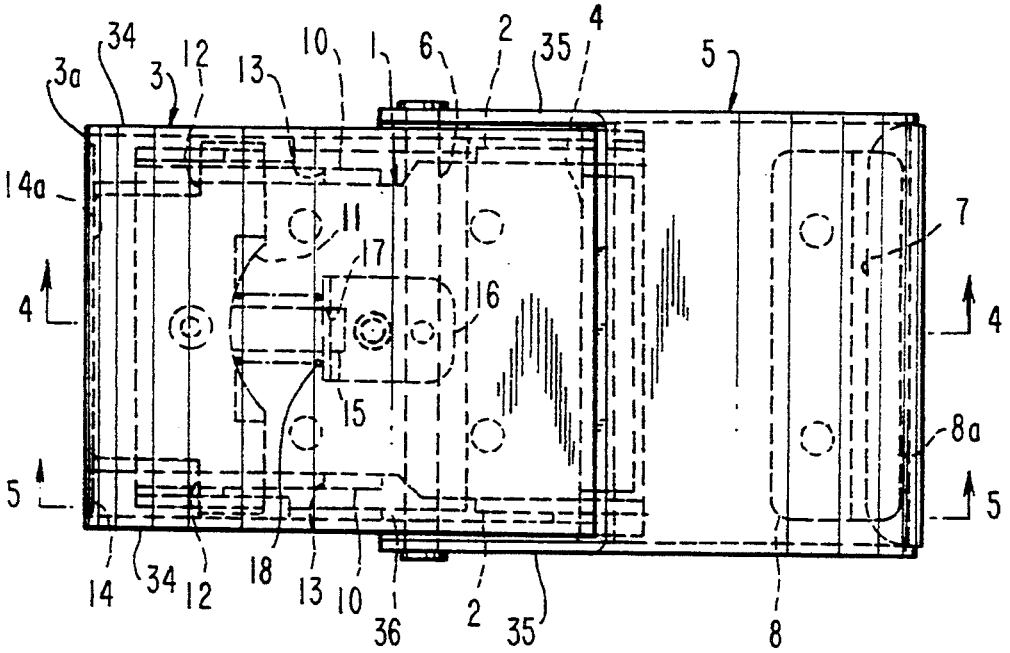
FIG. 1 is a front view of an embodiment of the latch assembly of the present invention in its locked condition.
Figure 2:
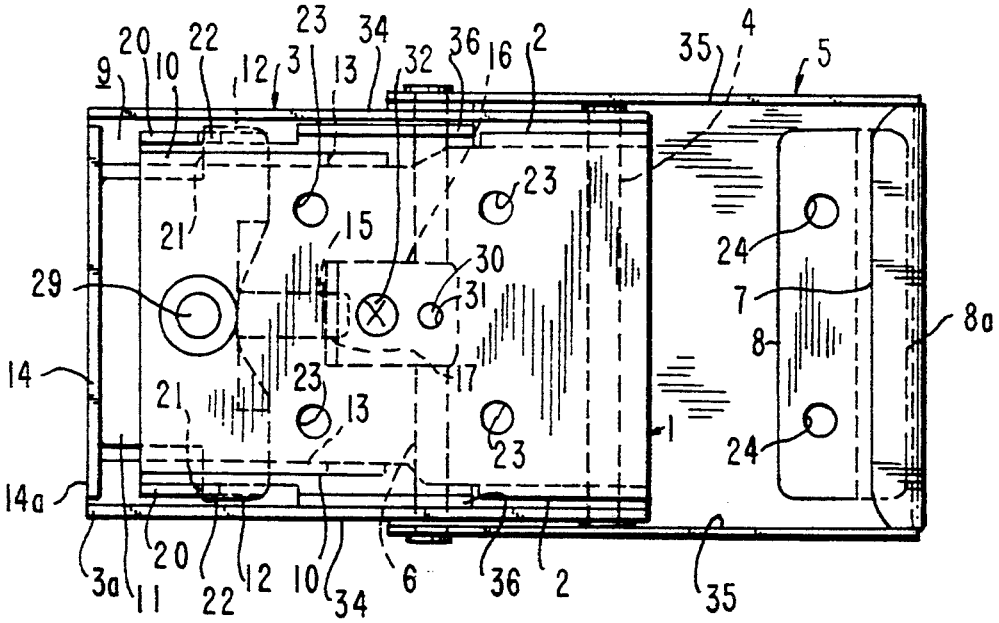
FIG. 2 is a rear view of the latch assembly of the present invention shown in FIG. 1.

Hereinbelow, the present invention will be described in detail with reference to the accompanying drawings and the reference numerals and characters.

In a latch assembly of the present invention, an operating lever 3 has its base-end portion pivoted to bearing plate portions 2, 2 of a base plate 1 through a first pivot 4. The bearing plate portions 2, 2 project from an end portion of the base plate 1. A latch arm 5 has its base-end portion pivoted to an intermediate portion of the operating lever 3 through a second pivot 6. The second pivot 6 and the first pivot 4 are so arranged that the base plate 1 is closer to the second pivot 6 than to a straight line drawn between the first pivot 4 and an engaging-end portion 8*a* of a socket member 8 in a locking condition in which a front-end hook portion 7 of the latch arm 5 engages with the engaging-end portion 8*a* of the socket member 8.

The base plate 1 is provided with a pair of guide plate portions 10, 10 in the base plate other end portion in a projecting manner. Each of the guide plate portions 10 is inserted in a rear-surface side cavity portion 9 of the operating lever 3. The guide plate portions 10, 10 are provided with a pair of slots 13, 13 extending in a longitudinal direction of the base plate 1, in which slots 13, 13 a pair of projecting plate portions 12, 12 of a lock plate 11 are slidably inserted. A push plate 14 fixedly mounted on the lock plate 11 has its base-end portion disposed in the vicinity of a finger-engaging end portion 3*a* of the operating lever 3.

The push plate 14 is provided with a spring-support plate portion 15 in its front-end portion. The spring-support plate portion 15 is slidably inserted in a through-hole 17 of a spring-support plate 16 projecting from an intermediate portion of the base plate 1. A coil spring 18 is mounted on the spring-support plate portion 15 of the push plate 14 in an insertion manner, with the support plate 15 being inserted through the coil spring 18. The coil spring 18 is compressed between an end surface 14*a* of the push plate 14 and the spring-support plate portion 16 to bias the push plate 14, so that each of the projecting plate portions 12, 12 abuts against the far one surface 13*a* of inner wall surfaces 13*a*, 13*b* of each of the slots 13, 13. The first pivot 4 is further away from the far one surface 13*a* of the inner wall surfaces 13*a*, 13*b* than from the other one surface 13*b* thereof.

A socket-member plate 19 is fixedly mounted on the operating lever 3 and provided with a pair of locking plate portions 20, 20 projecting into the rear-surface side cavity portion 9. The locking plate portions 20, 20 are provided with a pair of locking notches 21, 21 in their side edge portions. The locking notches 21, 21 are engaged with and disengaged from the projecting plate portions 12, 12 of the lock plate 11. Each of the locking plate portions 20, 20 is provided with an oblique can surface portion 22 in its front-end portion. The oblique cam surface portion 22 is adjacent to each of the locking notches 21, 21 and brought into a slidable contact with an edge surface 12*a* of each of the projecting plate portions 12, 12 of the lock plate 11 to slidably move the lock plate 11 toward the other one surface 13*b* of the inner wall surfaces 13*a*, 13*b* along the slots 13, 13.

Figure 3:
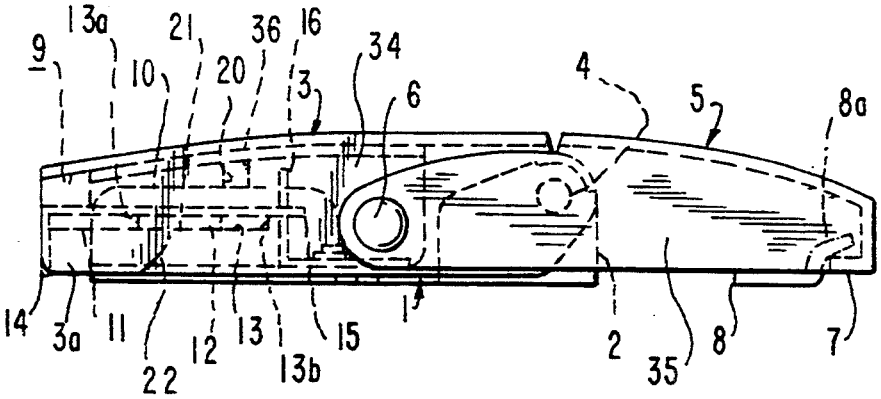
FIG. 3 is a bottom side view of the latch assembly of the present invention shown in FIG. 1.
Figure 4:
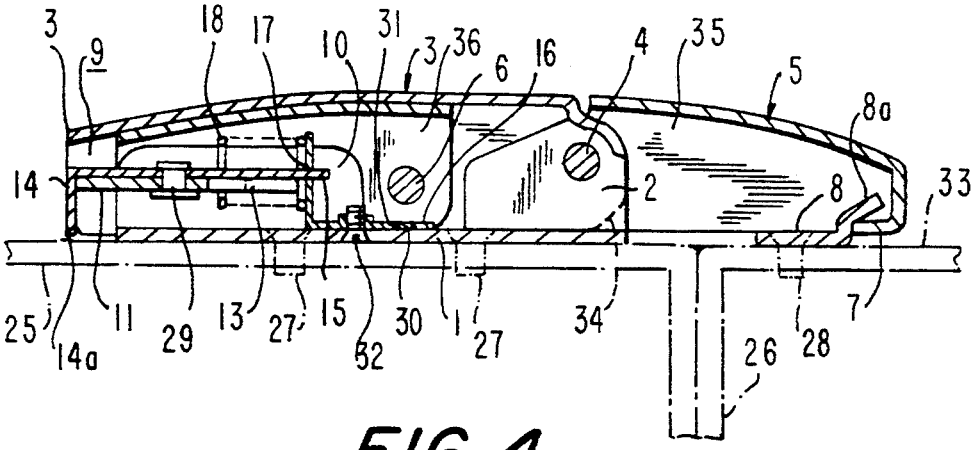
FIG. 4 is a longitudinal sectional view of the latch assembly of the present invention, taken along the line A—A of FIG. 1.
Figure 5:
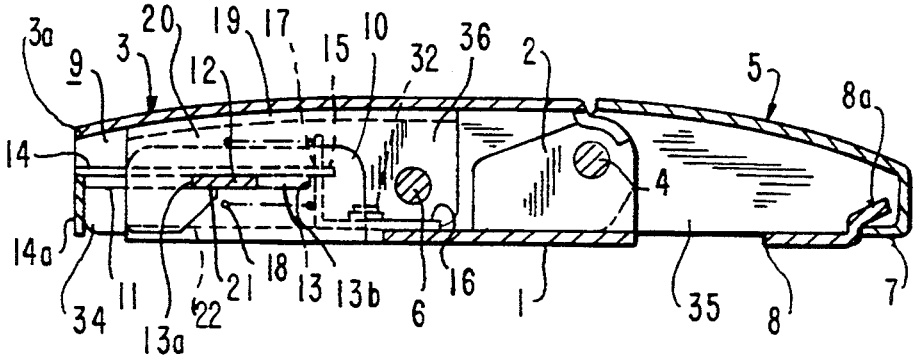
FIG. 5 is longitudinal sectional view of the latch assembly of the present invention, taken along the line B—B of FIG. 1.

The base plate 1 is fixedly mounted on a wing element 25. On the other hand, the socket member 8 is fixedly mounted on a stationary frame 26. In operation, when the wing element 25 is closed and locked to the stationary frame 26: the operating lever 3 lies on the base plate 1; as shown in FIG. 3, the base plate 1 is closer to the second pivot 6 than to the straight line drawn between the first pivot 4 and the engaging-end portion 8*a* of the socket member 8; the guide plate portions 10 of the base plate 1 are inserted in the rear surface side cavity portion 9; and, the locking plate portions 20, 20 of the socket-member plate 19 fixedly mounted on the operating lever 3 are oppositely disposed from outer sides of the guide plate portions 10, 10.

The projecting plate portions 12, 12 of the lock plate 11 inserted into the slots 13, 13 of the guide plate portions 10, 10 are engaged with the locking notches 21, 21 of the locking plate portions 20, 20. Since each of the projecting plate portions 12, 12 is biased toward the far one surface 13*a* of the inner wall surfaces 13*a*, 13*b* of the slot 13 relative to the first pivot 4 under the influence of a resilient force exerted by the coil spring 18, each of the projecting plate portions 12 is firmly engaged with each of the locking notches 21 so that the operating lever 3 is locked to the base plate 1. Consequently, the wing element 25 is kept in its locking condition in which the wing element 25 is locked to the stationary frame 26.

In order to unlock the assembly to release the wing element 25 from the stationary frame 26, it is necessary for the user to push the push plate 14 (which is integrally formed with the lock plate 11) with his fingers toward the first pivot 4 along the slots 13 of the guide plates 10. When each of the projecting plate portions 12 of the lock plate 11 slidably moves toward each of the inner wall surfaces 13*b* of the slots 13 by a predetermined distance, the projecting plate portions 12 are disengaged from the locking notches 21 of the locking plate portions 20 so that the operating lever 3 is released from the base plate 1.

Then, the operating lever 3 is pulled up by the user having his fingers engaged with the finger-engaging end portion 3*a* of the operating lever 3 to have the operating lever 3 swung up on first pivot 4 in a condition in which the push plate 14 is held in its depressed position. As a result, the push plate 14 is released from its depressed position when the operating lever 3 is swung through a predetermined angle up to which the projecting plate portions 12 can not be engaged again with the locking notches 21. After such releasing of the push plate 14, the lock plate 11 is automatically returned to a position in which the projecting plate portions 12 thereof abut against the inner wall surfaces 13*a* of the slots 13, under the influence of the resilient force exerted by the coil spring 18.

When the operating lever 3 is further swingably pulled up relative to the base plate 1, the second pivot 6 moves toward the front end of the base plate 1. Consequently, the latch arm 5 swung on the second pivot 6 has its front-end hook portion 7 disengaged from the engaging-end portion 8*a* of the socket member 8 so that the wing element 25 is released from the stationary frame 26. As a result, the user may pull the operating lever 3 or some other proper handle means to open the wing element 25.

After completion of the predetermined operations, the wing element 25 is closed and the operating lever 3 is depressed to swing down on the first pivot 4, so that the front-end hook portion 7 of the latch arm 5 is brought into a slidable contact with a front plate portion 33 of the stationary frame 26 and moved toward the engaging-end portion 8*a* of the socket member 8. When the base plate 1 is closer to the second pivot 6 than to the straight line drawn between the first pivot 4 and the engaging-end portion 8*a* of the socket member 8, the front-end hook portion 7 of the latch arm 5 is firmly engaged with the engaging-end portion 8*a* of the socket member 8 so that the wing element 25 is locked to the stationary frame 26.

In the last stage of such swingable depressing operation of the operating lever 3, the oblique cam surface portion 22 of each of the locking plate portions 20 is brought into a slidable contact with an edge surface 12*a* of each of the projecting plate portions 12 of the lock plate 11, and the lock plate 11 is slidably moved toward the near one surface 13*b* of the inner wall surfaces 13*a*, 13*b* of the slots 13 relative to the first pivot 4. When the swingable depressing operation of the operating lever 3 is completed, each of the projecting plate portions 12 reaches a position in which each of the projecting plate portions 12 is oppositely disposed from an opening end of each of the locking notches 21, and is immediately engaged with each of the locking notches 21 automatically under the influence of the resilient force exerted by the coil spring 18 so that the operating lever 3 is locked again to the base plate 1.

In the embodiment of the present invention shown in the drawings, the base plate 1 is fixedly mounted on the wing element 25 by means of fasteners 27 such as screws passed through four mounting holes 23 of the base plate 1. On the other hand, the socket member 8 is fixedly mounted on the stationary frame 26 by means of fasteners 28 such as screws passed through a pair of mounting holes 24 of the socket member 8. The number of the bearing plate portions 2 of the base plate 1 is two and they are vertically arranged so as to project forward from the base plate 1. The first pivot 4 is a cross pivot interposed between right-end portions of a vertically-arranged pair of side-wall plate portions 34, 34 of the operating lever 3. On the other hand, the second pivot 6 is a cross pivot interposed between intermediate portions of a vertically-arranged pair of side-wall plate portions 34, 34 of the operating lever 3, and between left-end portions of a vertically-arranged pair of side-wall plate portions 35, 35 of the latch arm 5.

Although the lock plate 11 can be integrally formed with the push plate 14, in the embodiment of the present invention shown in the drawings, they are separately formed and then assembled together by spot welding and further by means of fasteners 29 such as rivets and the like. Although the spring-support plate 16 can be integrally formed with the base plate 1 by partially cutting the same 1, in the embodiment of the present invention, the spring-support plate 16 is formed independently of the base plate 1. Then, a positioning projection 30 of the base plate 1 is inserted in a positioning hole 31 of the spring-support plate 16. After that, the spring-support portion 16 is fixedly mounted on the base plate 1 by means of screws 32.

Although the socket-member plate 19 can be integrally formed with the operating lever 3, in the embodiment of the present invention, they are separately formed and assembled together by spot welding. In the socket-member plate 19, there is vertically provided a pair of reinforcing plate portions 36, 36 in which the second pivot 6 is inserted. The push plate 14 is provided with a wide finger-engaging plate portion 14*a* which is bent rearward.

In the latch assembly of the present invention having the above construction: the operating lever 3 has its base-end portion pivoted to the bearing plate portions 2, 2 of an end portion of the base plate 1 through the first pivot 4; the latch arm 5 has its base-end portion pivoted to the intermediate portion of the operating lever 3 through the second pivot 6; and, the projecting plate portions 12, 12 of the lock plate 11, which are inserted in the slots 13, 13 of the guide plate portions 10, 10 of the base plate 1, are engaged with the locking notches 21, 21 of the locking plate portions 20, 20 of the socket-member plate 19 (which is fixedly mounted on the operating lever 3), and kept in such engaging condition under the influence of a resilient force exerted by the coil spring 18, so that the operating lever 3 is locked to the base plate 1. In the assembly, since the push plate 14 for having the lock plate 11 disengaged from the socket-member plate 19 is disposed in the rear-surface side cavity portion 9 of the operating lever 3, there is no fear that the operating lever 3 is accidentally hit by some other articles, and, therefore the operating lever 3 can not be accidentally pulled up swingably to be unlocked.

What is claimed is:

1. A latch assembly, comprising:

an operating lever (3) having a base-end portion pivoted to bearing plate portions (2, 2) of a base plate (1) through a first pivot (4), the bearing plate portions (2, 2) projecting from a one end portion of said base plate (1);

a latch arm (5) having a base-end portion pivoted to an intermediate portion of said operating lever (3) through a second pivot (6);

said second pivot (6) and said first pivot (4) being so arranged that said base plate (1) is closer to said second pivot (6) than to a straight line drawn between said first pivot (4) and an engaging-end portion (8*a*) of a socket member (8) in a locking condition in which a front-end hook portion (7) of said latch arm (5) engages with said engaging-end portion (8*a*) of said socket member (8);

said base plate (1) being provided with a pair of guide plate portions (10, 10) in its other end portion, said guide plate portions (10, 10) being inserted in a rear-surface side cavity portion (9) of said operating lever (3);

said guide plate portions (10, 10) being provided with a pair of slots (13, 13) extending in a longitudinal direction of said base plate (1), in which slots (13, 13) a pair of projecting plate portions (12, 12) of a lock plate (11) are slidably inserted;

a push plate (14) having a base-end portion disposed in the vicinity of a finger-engaging end portion (3*a*) of said operating lever (3), said push plate (14) being fixedly mounted on said lock plate (11);

said push plate (14) being provided with a spring-support plate portion (15) in a front-end portion, said spring-support plate portion (15) being slidably inserted in a through-hole (17) of a spring-support plate (16) projecting from an intermediate portion of said base plate (1);

a coil spring (18) mounted on said spring-support plate portion (15) of said push plate (14) with the support plate portion (15) being inserted through the coil spring (18), said coil spring (18) being compressed between an end surface (14*a*) of said push plate (14) and said spring-support plate portion (16) to bias said push plate (14) so that each of said projecting plate portions (12, 12) abuts against a far one surface (13*a*) of inner wall surfaces (13*a*, 13*b*) of each of said slots (13, 13), said first pivot (4) being farther away from said far one surface (13*a*) of the inner wall surfaces (13*a*, 13*b*) than from an other one surface (13*b*) thereof;

a socket-member plate (19) fixedly mounted on said operating lever (3) and being provided with a pair of locking plate portions (20, 20) projecting into the rear-surface side cavity portion (9), said locking plate portions (20, 20) being provided with a pair of locking notches (21, 21) in side edges of the locking plate portions, said locking notches (21, 21) being engaged with and disengaged from said projecting plate portions (12, 12) of said lock plate (11); and each of said locking plate portions (20, 20) being provided with an oblique cam surface portion (22) in a front-end portion, said oblique cam surface portion (22) being adjacent to each of said locking notches (21, 21) and brought into a slidable contact with an edge surface (12*a*) of each of said projecting plate portions (12, 12) of said lock plate (11) to slidably move said lock plate (11) toward the other one surface (13*b*) of said inner wall surfaces (13*a*, 13*b*) along said slots (13, 13).

2. The latch assembly of claim 1, wherein said base plate (1) is fixedly mounted on a wing element (25), and said socket member (8) is fixedly mounted on a stationary frame (26).

* * * * *